US005984003A

United States Patent [19]

Butler

[11] Patent Number: 5,984,003

[45] Date of Patent: Nov. 16, 1999

[54] SYSTEM AND METHOD FOR CONTROLLING OPERATION OF A MULTI-SPEED CIRCULATION BLOWER IN A HEATING AND COOLING APPARATUS

[75] Inventor: William P. Butler, St. Louis, Mo.

[73] Assignee: Emerson Electric Co., St. Louis, Mo.

[21] Appl. No.: 09/177,073

[22] Filed: Oct. 22, 1998

[51] Int. Cl.[6] ..... F24F 11/04; F24H 3/00

[52] U.S. Cl. ..... 165/245; 126/116 A; 236/11

[58] Field of Search ..... 236/11 A; 165/245–247; 126/116 A

[56] References Cited

U.S. PATENT DOCUMENTS 4,789,330 12/1988 Ballard et al. ..... 431/75
4,815,524 3/1989 Dempsey et al. ..... 165/245
4,887,767 12/1989 Thmposon et al. ..... 236/1 EB
4,951,870 8/1990 Ballard et al. ..... 236/11
5,197,664 3/1993 Lynch ..... 236/11
5,329,417 7/1994 Kniepkamp et al. ..... 361/185
5,372,120 12/1994 Swilik, Jr. et al. ..... 126/116 A
5,377,909 1/1995 Kirkpatrick ..... 236/11

*Primary Examiner*—William Wayner
*Attorney, Agent, or Firm*—Paul A. Becker, Sr.

[57] ABSTRACT

In a heating system, when a high limit opens a predetermined number of times in a single call for heat by the thermostat, the system provides for operating the circulator blower at the cool speed rather than at the heat speed.

8 Claims, 3 Drawing Sheets

SYSTEM AND METHOD FOR CONTROLLING OPERATION OF A MULTI-SPEED CIRCULATION BLOWER IN A HEATING AND COOLING APPARATUS

BACKGROUND OF THE INVENTION

This invention relates to systems for controlling operation of a multi-speed circulation blower in a heating and cooling apparatus, and particularly to such systems wherein the number of times a high limit switch has opened during a single call for heat determines the blower speed.

In gas-fired, warm-air furnaces, it is desirable to prevent the temperature in the plenum from exceeding a certain value so as to protect the furnace and its environment from the effects of excessively high temperatures. Accordingly, a high limit switch is typically located in the plenum. The high limit switch opens when the sensed plenum temperature rises to a certain value. If the thermostat is still calling for heat, the opening of the switch breaks the electrical power to the gas valve so that the gas flame is extinguished. It is desirable that the circulation blower in the furnace be energized under this condition so that the excessive heat is removed from the plenum. Therefore, when the high limit switch opens, the blower is energized, if it is not already energized. In the prior art, this function has been provided either directly by the high limit switch by utilizing a high limit switch having a set of normally-open contacts which close on temperature rise and complete an electrical circuit directly to the circulator blower, or indirectly by the high limit switch acting through a microcomputer-based furnace control.

In the microcomputer-based furnace control arrangement, there are usually two or more outputs from the microcomputer for controlling the circulation blower. During the heating mode, one output effects energizing of a heat speed winding of the blower motor, and during the cooling mode, another output effects energizing of a cool speed winding of the motor. In response to an opening of the high limit switch, which would occur only during the heating mode, the output that is in control of the blower is the output which effects energizing of the heat speed winding.

There are several possible reasons why the high limit switch may open. One reason is that the air filter in the circulation path may be excessively dirty so that the filter does not permit enough air to be drawn out of the plenum, with the heat speed velocity, to cool it sufficiently. Another reason is that the furnace control may be defective. For example, a relay or a relay drive circuit in the furnace control may be defective so that the heat speed winding of the circulation blower motor is not energized when the controlling circuitry indicates it should be energized.

If the high limit opened due to a dirty filter, enough heat should be removed from the plenum and distributed to the conditioned space by the circulating air, even with a dirty filter, so that the thermostat should become satisfied before the high limit has a chance to close again. However, if the high limit opened due to the heat speed winding of the circulation blower motor not being energized when the controlling circuitry indicates it should be energized, the response to the opening of the high limit of re-energizing the heat speed winding of the blower motor has no effect on blower operation. That is to say, the blower will not operate, no heat will be circulated to the conditioned space, and the plenum will again be heated, causing the high limit to open again. Such operation could continue until the control locks out, terminating all furnace activity for at least some period of time. If the conditioned space is occupied, such lack of heat would be observed and corrective action could be taken, such as calling a service man. However, if the conditioned space is unoccupied, such inadequate heating would go unnoticed until the occupants returned. Depending on the temperature of the conditioned space, such inadequate heating could result in, for example, frozen water pipes. To prevent such inadequate heating, it is desirable that some means be provided for circulating warm air if the problem is caused by defective heat speed operation of the blower.

SUMMARY OF THE INVENTION

An object of this invention is to provide a generally new and improved system and method for operating a multi-speed circulation blower comprising operating the blower at cool speed in response to a predetermined number of times a high limit switch has opened during a single call for heat.

In a preferred embodiment, a heating and cooling system includes a thermostat, a high limit switch, a gas valve, a circulation blower having a heat speed and a cool speed, and microcomputer-controlled means for controlling operation of the blower. The first two times that the high limit opens during a single call for heat from the thermostat causes the blower to be energized to run at its heat speed. If the high limit opens a third time during the single call for heat, the blower is energized to run at its cool speed. Preferably, on any subsequent openings of the high limit during the single call for heat, the blower will be energized to run at its cool speed. Such a system and method for operating the blower will result in circulation of warm air if the lack of circulation was due only to defective heat speed operation of the blower and if the blower does operate properly at cool speed.

The above mentioned and other objects and features of the present invention will become apparent from the following description when read in conjunction with the accompanying drawings.

DESCRIPTION OF THE PREFERRED EMBODIMENT

Figure 1:
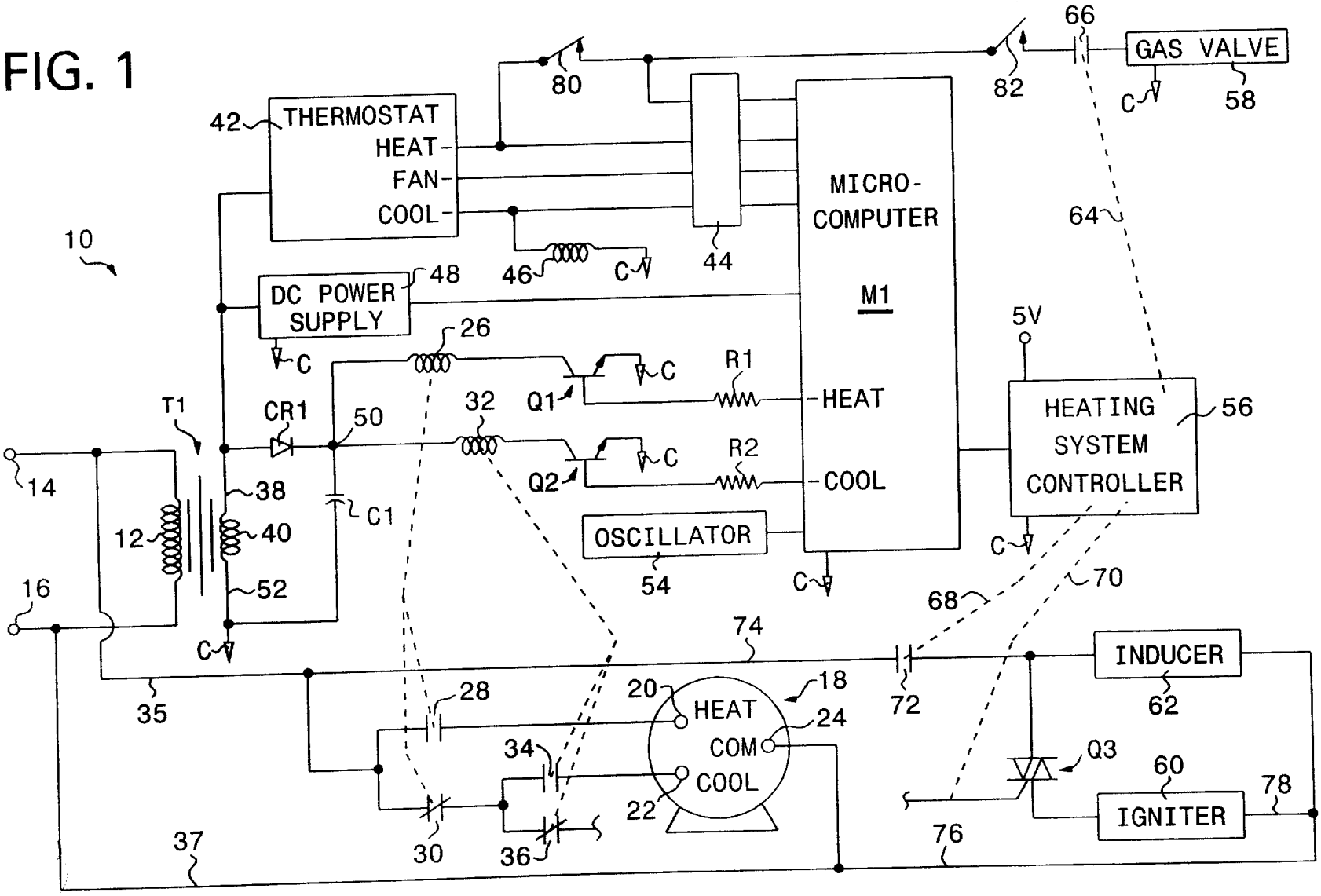
FIG. 1 is a schematic illustration, largely in block form, of a heating and cooling system incorporating the present invention.

Referring to FIG. 1, a heating and cooling system is indicated generally at 10. System 10 includes a voltage step-down transformer T1 having a primary winding 12 connected to terminals 14 and 16 of a conventional 120 volt alternating current power source.

Shown generally at 18 is a two-speed motor which drives a blower (not shown) which circulates conditioned air throughout the dwelling. Motor 18 has an input terminal 20 for providing a first blower speed for use during the heating mode, an input terminal 22 for providing a second blower speed for use during the cooling mode, and a common terminal 24. One of the two blower speeds is also used when continuous blower operation is desired.

A first relay comprises a relay coil 26 and normally-open contacts 28 and normally-closed contacts 30. A second relay comprises a relay coil 32 and normally-open contacts 34 and normally-closed contacts 36. Terminal 20 of motor 18 is connected to terminal 14 of the AC power source through relay contacts 28 and a lead 35; terminal 22 of motor 18 is connected to terminal 14 through relay contacts 34 and 30; and terminal 24 is connected to terminal 16 by a lead 37. While relay contacts 36 provide no function in the embodiment shown, it is to be understood that the type of circuitry and method of operating relay coils 26 and 32 could also be used to operate additional relays. For example, if motor 18 were a three-speed motor, wherein a third speed is utilized for continuous blower operation, another relay having its normally-open contacts in series with the normally-closed contacts 36 and the proper input terminal of the motor could be added.

One end 38 of the secondary winding 40 of transformer T1 is connected to a thermostat 42. Thermostat 42 provides signals through a buffer 44 to a microcomputer M1, such signals being indicative of a demand or no demand for heating, cooling, and/or fan functions. (the word "fan" refers to the blower operated by motor 18.) The operating coil 46 of a contactor for controlling cooling apparatus such as a compressor (not shown) is connected between the COOL output of thermostat 42 and chassis common C, hereinafter referred to as common C.

End 38 of secondary winding 40 is also connected to a DC power supply 48. DC power supply 48 is effective to provide a stable 5-volt power supply for microcomputer Ml and for various other circuit components.

End 38 of secondary winding 40 is also connected through a controlled rectifier CR1 to a junction 50. A capacitor C1 is connected between junction 50 and the other end 52 of secondary winding 40, which end 52 is connected to common C. Capacitor C1 filters the half-wave power supply provided by rectifier CR1 so as to establish a filtered unidirectional power source at junction 50.

Relay coil 26, the emitter-base circuit of an NPN transistor Q1 and a current limiting resistor R1 are connected in series between junction 50 and an output pin of microcomputer M1 designated as HEAT. Similarly, relay coil 32, the emitter-base circuit of an NPN transistor Q2 and a current limiting resistor R2 are connected in series between junction 50 and an output pin designated as COOL. The collectors of transistors Q1 and Q2 are connected to common C.

Also connected to microcomputer M1 is an oscillator 54 which establishes the machine cycle time. Oscillator 54, typically including a quartz crystal, also provides for various timing functions as will be hereinafter described.

Also connected to microcomputer M1 is a heating system controller 56 which comprises various circuitry to effect control of, for example, a gas valve 58, an igniter 60 and an inducer 62. More specifically, as shown at 64, controller 56 controls operation of relay contacts 66 in series with gas valve 58, and as shown at 68 and 70, controller 56 controls relay contacts 72 and triac Q3. Triac Q3 is in series with igniter 60, inducer 62 is in parallel with the series-connected triac Q3 and igniter 60, and relay contacts 72 is in series with the parallel circuit of inducer 62 and series-connected triac Q3 and igniter 60. Inducer 62 is connected at one end through relay contacts 72, a lead 74 and lead 35 to terminal 14 of the AC power source, and at its other end through a lead 76 and lead 37 to terminal 16 of the AC power source. Igniter 60 is connected at one end through triac Q3, relay contacts 72, and leads 74 and 35 to terminal 14, and at its other end through leads 78, 76 and 37 to terminal 16.

Connected in series between the HEAT output of thermostat 42 and gas valve 58 are a high limit switch 80, a pressure switch 82 and previously described relay contacts 66. High limit switch 80 is normally closed; it opens its contacts when the sensed temperature exceeds a pre-set value. Pressure switch 82 is normally open; it closes its contacts in response to the proper movement of combustion chamber air effected by inducer 62. The status of high limit switch 80 is monitored by microcomputer M1 through buffer 44. Microcomputer M1 also monitors various other circuit elements, such as pressure switch 82 and relay contacts 66. For brevity, the circuitry for effecting such monitoring functions is omitted.

Microcomputer M1, preferably in the MC68HC05 family of chips, is programmed to provide a desired method of operating heating and cooling system 10. While the method of operation entails many steps, only those portions deemed essential to enable an understanding of the present invention will be described in detail.

When thermostat 42 determines that heating is required, it provides a signal to microcomputer M1 which, in response, provides output signals to controller 56 to initiate the heating cycle. A typical heating cycle begins with a pre-purge. Specifically, controller 56 effects the closing of relay contacts 72 to enable energizing of inducer 62. Inducer 62 operates to purge the combustion chamber of the furnace of any unburned fuel or products of combustion that may be present in the combustion chamber. When inducer 62 operates properly, the resulting induced flow causes the contacts in pressure switch 82 to close.

After pre-purge, relay contacts 72 remain closed, and controller 56 effects conduction of triac Q3. With relay contacts 72 closed and triac Q3 conducting, igniter 60, typically a hot surface igniter, is energized. When the igniter is hot enough to ignite gas, controller 56 effects closing of relay contacts 66 which, in turn, effects opening of gas valve 58 to allow gas to flow to the burner (not shown). Ignition occurs and, after a predetermined time, microcomputer M1 provides a signal to turn on transistor Q1 so to enable relay coil 26 to be energized by the power source at junction 50. With relay coil 26 energized, its controlled contacts 28 close, enabling the heat speed winding of motor 18 to be energized, thus enabling the blower to run at the heating speed, hereinafter referred to as the heat speed.

When thermostat 42 is satisfied, it no longer provides a call-for-heat signal to microcomputer M1. In response, controller 56 effects opening of relay contacts 66 whereby gas valve 58 is closed. A post-purge period is then typically provided wherein inducer 62 continues to operate so as to purge the combustion chamber. Finally, after a predetermined time, microcomputer M1 provides a signal to turn off transistor Ql so as to cause relay coil 26 to be de-energized and effect opening of its contacts 28 and thereby terminate operation of motor 18.

When thermostat 42 determines that cooling is required, it provides a signal to microcomputer M1 and also provides an energizing circuit to contactor coil 46. With contactor coil 46 energized, the compressor (not shown) is turned on. The signal to microcomputer M1 results in microcomputer M1 providing a signal to turn on transistor Q2 so to enable relay coil 32 to be energized by the power source at junction 50. With relay coil 32 energized, its controlled contacts 34 close, enabling the cool speed winding of motor 18 to be energized, thus enabling the blower to run at the cooling speed, hereinafter referred to as the cool speed. When thermostat 42 is satisfied, contactor coil 46 is de-energized whereby the compressor is turned off; also, a call-for-cool signal is no longer provided to microcomputer M1. After a predetermined time, microcomputer M1 provides a signal to turn off transistor Q2 so as to cause relay coil 32 to be de-energized and effect opening of its contacts 34 and thereby terminate operation of motor 18.

Heat limit switch 80 is located in the furnace plenum. It opens when the sensed plenum temperature rises to a certain value so as to protect the furnace and its environment from the effects of excessively high temperatures. Under normal operating conditions, high limit switch 80 remains closed during the entire time that thermostat 42 calls for heat. However, there are several abnormal conditions which could cause the high limit switch 80 to open before the call for heat is satisfied. For example, the filter in the circulation path might be excessively dirty so that it does not permit enough of the hot air to be drawn out of the plenum to cool the plenum sufficiently. Other abnormal conditions could be a defective circuit component or defective motor 18, any of which could prevent motor 18 from operating properly in the heating mode.

Typically, a dirty filter will cause no more than one opening of high limit switch 80 in a single call for heat. However, the other above-recited abnormal conditions will result in multiple openings of high limit switch 80 in a single call for heat. Such multiple openings of high limit switch 80 will result in inadequate heating of the conditioned space. If the conditioned space is occupied, the occupant could contact a service man. However, if the conditioned space is not occupied, such inadequate heating would go unnoticed until the occupants returned. Depending on the temperature of the conditioned space, water pipes could freeze and eventually burst.

The present invention provides a solution when the above-recited abnormal conditions affect only the heating mode. Specifically, in the heating mode, in the event that the blower is inoperative to provide the heat speed, microcomputer M1 is programmed to attempt operating the blower at the cool speed. For example, the heat speed may be inoperative due to a failed winding in motor 18, a failed circuit component such as relay coil 26, contacts 28, transistor Q1, or a drive circuit. Accordingly, microcomputer M1 includes routines illustrated in FIGS. 2A, 2B, and 3.

Figure 3:
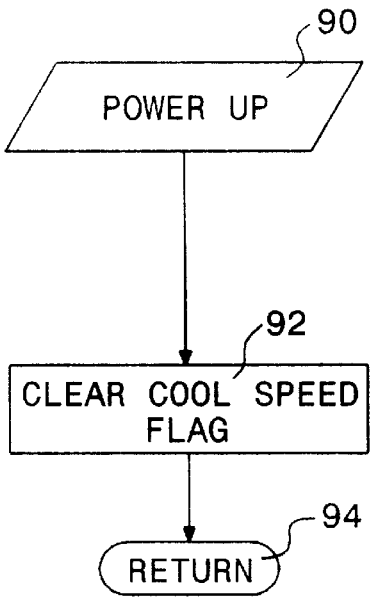
FIG. 3 is a flow chart depicting a portion of the logic sequence of a power up routine programmed into and executed by the microcomputer in the system of FIG. 1.

Referring first to FIG. 3, a power up routine 90 is executed on an initial application of electrical power to microcomputer M1 and on any subsequent re-application after electrical power was absent. In the power up routine 90, a cool speed flag is cleared at step 92 and the routine goes to RETURN at 94. The function of the cool speed flag will be described hereinafter.

Figure 2A:
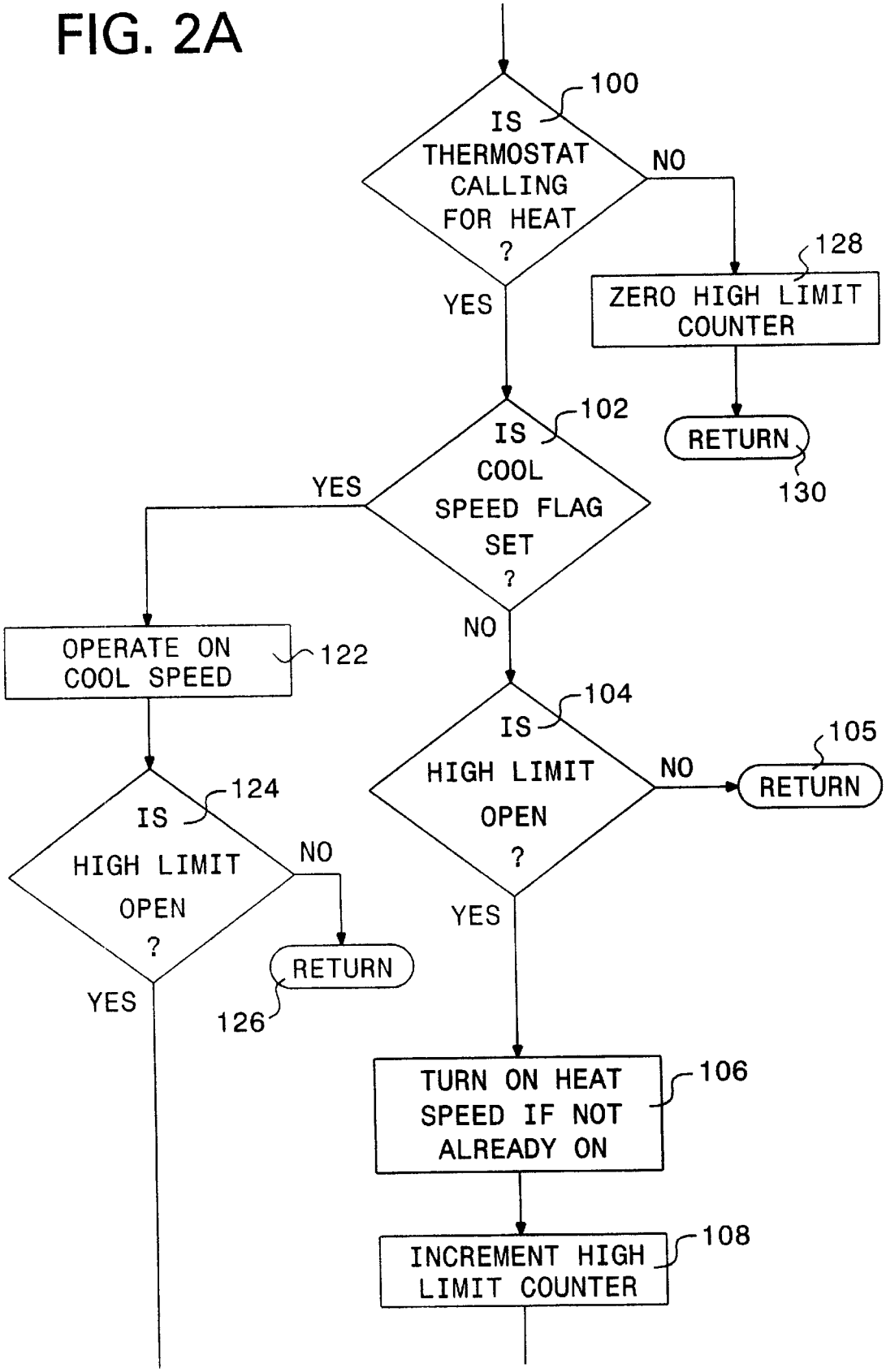
FIGS. 2A and 2B, when combined, is a flow chart depicting the logic sequence of a routine programmed into and executed by the microcomputer in the system of FIG. 1.

Referring to FIG. 2A, the first step 100 therein is an inquiry as to whether thermostat 42 is calling for heat. For illustration purposes, assume this is the first call for heat after powerup so that all flags are cleared. If the answer to inquiry 100 is yes, the next step 102 is an inquiry as to whether a cool speed flag is set. Since the cool speed flag was zeroed at power up and therefore is not set at this point, the next step 104 is an inquiry as to whether high limit switch 80 is open. If yes, the heat speed of the blower is turned on in step 106 if it is not already on, and a high limit counter, which is zeroed when thermostat 42 terminates its call for heat, is incremented in step 108.

Figure 2B:
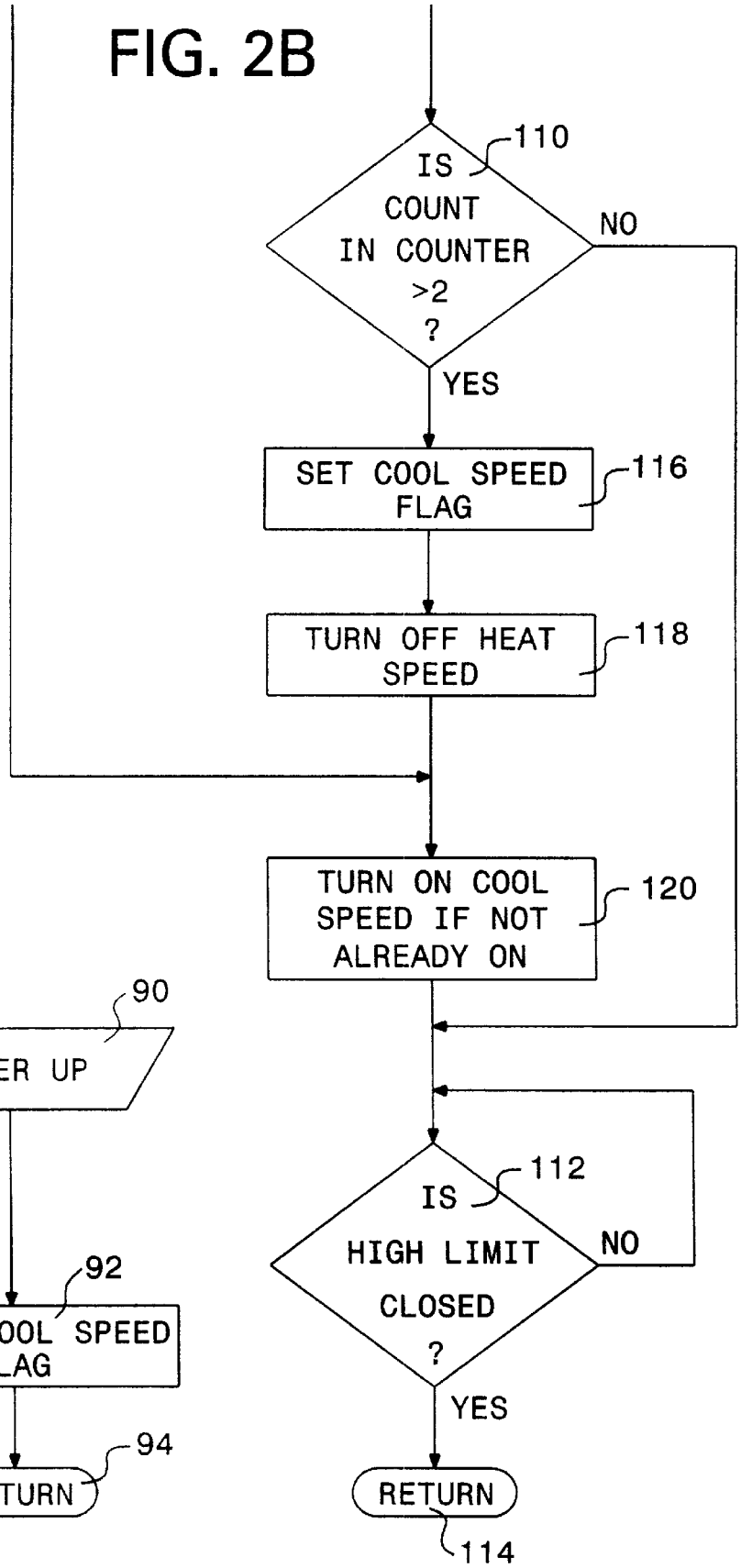

Referring to FIG. 2B, the next step 110 is whether the count in the high limit counter is greater than two. The count should be one at this point, so the logic proceeds to step 112 which is an inquiry as to whether high limit switch 80 is closed. The logic remains in a closed loop until high limit switch 80 closes, enabling the routine to then advance to RETURN at 114.

The routine would then jump from RETURN at 114 back to step 100. If thermostat 42 is still calling for heat, the routine advances to step 102. Again, in step 102, the answer to whether the cool speed flag is set is negative at this time so that the logic proceeds to step 104. If high limit switch 80 is closed at step 104, the routine goes to RETURN at 105 and then back to step 100. However, if high limit switch 80 opens again at step 104, the logic in steps 106 and 108 apply, and the count in the counter of step 108 becomes a count of two. Again, the negative answer to the inquiry of step 110 causes the logic to proceed to the inquiry of step 112. If high limit switch 80 remains open, the logic remains in the closed loop involving step 112; if high limit switch 80 again closes, the routine goes to RETURN at 114.

On the subsequent return to step 100, the routine would proceed as before to either RETURN at 105 or to step 108. At step 108, the counter is incremented to a count of three. According to step 110, now that the count is greater than two, the cool speed flag is set in step 116 and the heat speed of the blower is turned off in step 118. The cool speed is then turned on in step 120.

If, in fact, a defective heat speed operation caused the three openings of high limit switch 80 in a single call for heat by thermostat 42, the switching of the blower to the cool speed should prevent further openings of high limit switch 80. Thus, the logic should proceed from step 112 to RETURN at 114, and then back to step 100.

Assume that thermostat 42 continues to call for heat in step 100. Since the cool speed flag is now set, logic steps 102 and 122 dictate that the blower will continue to operate on cool speed. The next logic inquiry at step 124 is whether high limit switch 80 is open. If no, the routine advances to RETURN at 126. If yes, the routine advances to steps 120 and 112 and remains in the closed loop involving step 112 until high limit switch 80 closes or thermostat 42 no longer calls for heat.

In accordance with the logic inquiry at step 100, when thermostat 42 no longer calls for heat, the high limit counter is zeroed at step 128 and the routine goes to RETURN at 130. The reason for zeroing the high limit counter is to prevent the number of times the high limit switch 80 opens in separate calls for heat from accumulating in logic step 108 and resulting in setting the cool speed flag in steps 110 and 116. Specifically, high limit switch 80 may occasionally open due to, for example, a dirty filter. Usually, such opening occurs only one time during a single call for heat.

In subsequent calls for heat, as long as power up routine 90 is not entered, which would clear the cool speed flag at step 92, the blower will operate at the cool speed.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

I claim:

1. In a heating system including a thermostat for establishing a call for heat, a high limit, and a blower having a heat speed and at least one other speed, an improved method for controlling operation of the blower wherein the improvement comprises:

counting the number of times said high limit opens during a single call for heat by said thermostat; and operating said blower at one of said at least one other speeds when said number of times said high limit opens reaches a predetermined value.

2. In a heating and cooling system including a fuel valve, a thermostat for establishing a call for heat, a high limit in series with the thermostat and fuel valve, and a blower having a heat speed and a cool speed, an improved method for controlling operation of the blower wherein the improvement comprises:

counting the number of times said high limit opens during a single call for heat by said thermostat; and operating said blower at said cool speed when said number of times said high limit opens reaches a predetermined value.

3. The method of claim 2 wherein said counting the number of times said high limit opens comprises the step of incrementing a counter, and wherein said operating said blower at said cool speed occurs when the count in said counter has incremented to said predetermined value, and wherein said method further includes the step of setting a cool speed flag when said count in said counter has incremented to said predetermined value.

4. The method of claim 3 wherein said counter is zeroed when said thermostat no longer calls for heat.

5. The method of claim 3 wherein said cool speed flag remains set when said thermostat no longer calls for heat.

6. In a heating and cooling system, a fuel valve;

a thermostat for establishing a call for heat;

a high limit in series with said thermostat and said fuel valve;

a circulation blower having a heat speed and a cool speed;

independently controlled relays for selectively operating said blower at said heat speed and said cool speed; and a microcomputer having input means responsive to said thermostat and said high limit for counting the number of times said high limit opens during a single call for heat by said thermostat, said microcomputer having output means for controlling said relays so as to effect operation of said blower at said cool speed when said number of times said high limit opens during a single call for heat by said thermostat reaches a predetermined value.

7. The control system of claim 6 wherein said input means includes a counter for incrementally counting said number of times said high limit opens during a single call for heat by said thermostat, and means, effective when the count in said counter reaches a value of three, for limiting operation of said blower to said cool speed.

8. The control system of claim 7 wherein said means for limiting operation of said blower to said cool speed can be cleared by a power up routine executed by said microcomputer whenever electrical power is applied to said microcomputer after electrical power was absent.

* * * * *